United States Patent [19]

Eley et al.

[11] 4,002,027

[45] Jan. 11, 1977

[54] MULTIPLE PUMP CONTROL SYSTEM

[75] Inventors: James M. Eley, Corinth, Miss.; Fred T. Smith, Dearborn Heights, Mich.

[73] Assignees: Tyrone Hydraulics, Inc., Corinth, Miss.; Sargent Industries, Inc., Los Angeles, Calif. ; part interest to each

[22] Filed: Jan. 28, 1976

[21] Appl. No.: 652,532

Related U.S. Application Data

[63] Continuation of Ser. No. 402,292, Oct. 1, 1973, abandoned.

[52] U.S. Cl. ..... 60/430; 60/468; 60/486; 417/286; 417/426; 137/115

[51] Int. Cl.[2] ..... F15B 13/09

[58] Field of Search ..... 60/428, 430, 468, 486, 60/494; 137/115, 116, 117, 118; 417/286, 426

[56] References Cited

UNITED STATES PATENTS

| | | | |
|---|---|---|---|
| 1,982,711 | 12/1934 | Vickers | 60/430 |
| 2,618,932 | 11/1952 | Taup | 60/430 |
| 2,905,191 | 9/1959 | Vander Kaay | 60/430 |
| 3,204,410 | 9/1965 | Tennis et al. | 60/430 |
| 3,459,131 | 8/1969 | Senf | 91/47 X |
| 3,540,218 | 11/1970 | Finn | 60/430 |
| 3,812,676 | 5/1974 | Smith | 60/431 |

OTHER PUBLICATIONS

"Tyrone Sales Engineering Newsletter No. 13", dated Oct. 26, 1967.

*Primary Examiner*—Edgar W. Geoghegan
*Attorney, Agent, or Firm*—Synnestvedt & Lechner

[57] ABSTRACT

A control system for plural motor driven pumps is disclosed. The control system includes a control valve which provides for unloading one pump by diverting the flow of operating fluid from that pump back to reservoir whenever the flow through the valve or the load pressure exceeds a preselected level.

20 Claims, 3 Drawing Figures

30
31
31a
32
20
22
29
39
38
37
35
27
19
37
60
26
40
28
34
58
61
18
33
49
42
52
41
45
21
50
47
44
46

30
31
31a
32
39
38
22
29
36
35
37
27
19
60
26
28
34
58
40
61
18
42
49
33
41
52
45
50
47
44
46

MULTIPLE PUMP CONTROL SYSTEM

This is a continuation of application Ser. No. 402,292 filed Oct. 1, 1973, now abandoned.

BACKGROUND OF THE INVENTION

The invention relates to a hydraulic control system including pump means comprising a plurality of hydraulic fixed displacement pumps, and valve means incorporating hydraulic control circuitry for unloading a pump in response to load pressure or rate of flow of operating fluid, thereby leading to quieter operation of hydraulic systems utilizing the pump.

The invention is especially adapted for use in control systems for operating a vehicle mounted hydraulic implement such as the refuse packer on a truck. One important aspect of the invention relates to a vehicle having a motor for powering the vehicle which motor also drives the pumps providing power for the hydraulic system.

The use of the invention leads to substantial reductions in the noise level attendant with prior art hydraulic systems when operating at high pressure or high engine speed, and can be used in a manner which facilitates quieter operation of refuse packing trucks and other equipment without impairment of the normal operating routine of those who work on the equipment.

According to the invention, a system is provided which incorporates two fixed displacement pumps which deliver hydraulic fluid for operating auxiliary mechanisms such as a hydraulic ram or other hydraulically operated work piece sometimes herein called the load. In a typical system a hydraulic pump is driven for example, via a power takeoff from the engine for propelling a truck or piece of earth moving equipment.

In a typical hydraulically operated packer, a single relatively large pump is used and for adequate flow of hydraulic fluid, the pump must be driven at a relatively high speed. When the vehicle on which the hydraulic system is mounted is at a standstill, the operator must speed up the vehicle engine in order to provide the necessary flow of fluid. The high speed of the engine at a time of relatively low horsepower requirement contributes a large percentage of the noise which is so objectionable to those in the vicinity. Coupled with this is the fact that the pump is also operating at high speed and pump noise goes up rapidly with speed.

With the multiple pump system provided by the invention, adequate flow of hydraulic fluid is provided with the engine running just above low idle speed and very little noise is generated from either the vehicle engine or the pump. At such low engine speeds the engine develops relatively low torque, but where load pressure is low, as for instance through about 90% of a packing cycle, there is adequate torque available to drive the multiple pump. During the latter portion of the cycle when load pressure is high and engine torque is inadequate to drive both pumps, the invention provides for unloading one pump in response to pressure. This immediately reduces the volume of operating fluid being pumped and accordingly reduces the torque required to turn the remaining pump section so that the high pressure required during the remaining portion of the packing cycle can be achieved. Since only a small portion of the packing cycle remains, the time required for completion of the packing cycle is increased very little.

The invention further provides a capability for shifting out one pump section in response to increase in engine speed above a predetermined level. An important advantage of this capability is that the hydraulic system can be operated while the vehicle is moving from one point to another without overtaxing the horsepower of the engine. In a refuse packer for example, when the truck is moving from one pickup station to another, a major portion of the engine horsepower is needed to propel the vehicle. With the invention an increase in engine speed above a predetermined level causes one section of the multiple pump to unload so that adequate horsepower is available for both functions. In addition, the unloading of one pump section in response to flow decreases the noise of the hydraulic system. As indicated, the use of the invention provides for relatively rapid compaction of the refuse throughout a substantial portion of the compaction stroke. Although the time interval required to complete compaction of trash may be lengthened, complete compaction can be effected at times when it does not interfere with the work routine of the individuals working on the truck, as for example when the truck is driven between pickup points or is being returned to the refuse disposal site.

SUMMARY AND OBJECTIVES

An important object of the invention is the provision of a hydraulic control system incorporating engine driven pump means which is substantially quieter in operation than has been heretofore practical.

A more specific object of the invention is a control system which provides two hydraulic pumps for pumping operating fluid to a load when load pressure or pump speed remain below predetermined levels and which cuts out one pump when either of these factors exceeds a predetermined level.

Another important object of the invention is the provision of a vehicle mounted refuse packer incorporating a hydraulic control system which facilitates compacting trash while the vehicle is being driven between pickup points.

Another object of the invention is the provision of a hydraulic control system incorporating two hydraulic pumps, which control system unloads one pump at high engine speeds, thereby reducing noise.

A related object of the invention is the provision of a hydraulic control system incorporating two hydraulic pumps which cuts out one pump at high load pressure.

The above and other objects of the invention are achieved by a hydraulic control system including hydraulic pump means for delivering operating fluid from a reservoir to a load and control valve means intermediate the pumps and the load. The valve means is further provided with a bypass to the reservoir and means for diverting the flow of one pump through the bypass and back to the reservoir. Preferably, this means comprises a valve member hving a pair of inlets connected respectively to a pair of pumps, a first outlet connected to the load and a second or bypass outlet connected to the reservoir. The valve member is operative in a first position to connect the inlets with the first outlet and in the second position to connect one inlet with the second outlet with the other outlet remaining in communication with the first outlet. A flow responsive device responsive to the flow of operating fluid downstream from the pumps shifts the member to a second position when a predetermined rate of flow is exceeded. A pressure responsive device is responsive to changes of pressure of fluid downstream from the pumps and acts on the valve member to shift the member to the other position when the predetermined pressure is exceeded.

DESCRIPTION OF THE DRAWINGS

Turning now to the detailed description, reference is made to the accompanying drawings in which.

DETAILED DESCRIPTION

Figure 1:
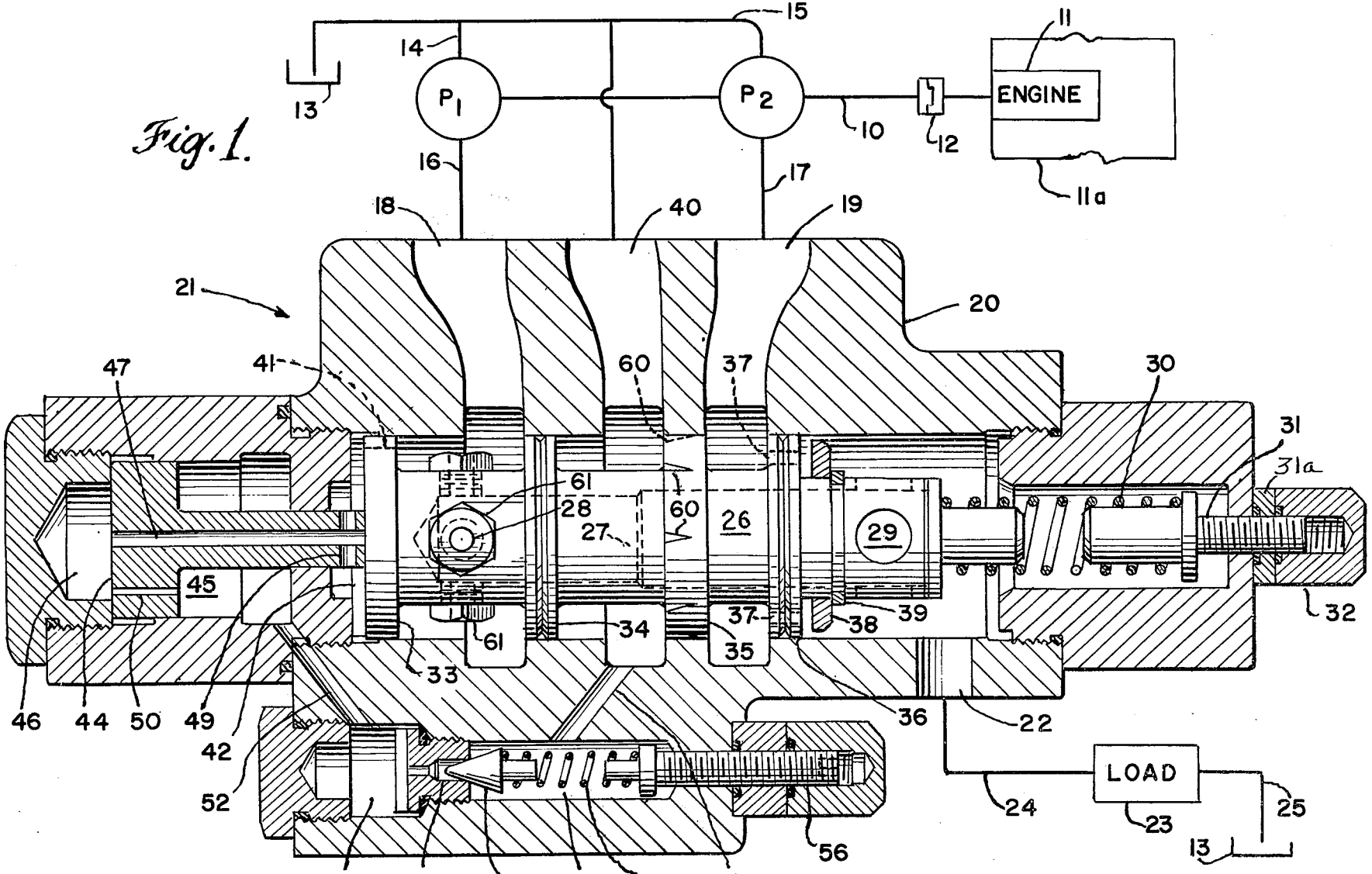
FIG. 1 is a combined schematic and sectional view of apparatus including a control valve incorporating the features of the invention.

Referring first to FIG. 1, the pump means of the illustrative embodiment of the invention comprises a pair of gear pumps or pump sections, P1 and P2 of known construction which are driven via a power take-off 10 from an engine 11 mounted on a vehicle schematically represented by the reference character 11*a*. In applications where use of the invention is contemplated, engine 11 is typically the engine for driving the vehicle on which the hydraulic control system is to be employed, and will vary in speed, causing variations in the output of the pump independently of the needs of the hydraulic system. A clutch 12 of known construction is provided intermediate the engine 11 and pumps P1 and P2. Clutch 12 is selectively engageable and disengageable by the operator so that the hydraulic system may be used at will.

Fluid is supplied to the suction side of the pumps from a reservoir 13 by way of supply passages 14 and 15. Discharge passages 16 and 17 connect to inlet passages 18 and 19 in the housing 20 of a control valve means generally indicated by the reference numeral 21. Valve means 21 is provided with a first outlet passage 22 through which the output of the pumps is conducted to the load 23 via a discharge passageway 24. A return line 25 from the load leads to the reservoir 13, from which the fluid is recirculated in the manner just described.

Referring again to FIG. 1, the valve means 21 is provided with a central bore located within the housing 20. A valve member or spool 26 is mounted for movement within the bore between a first position shown in FIG. 1 and a second position shown in FIGS. 2 and 3. Spool 26 is provided with an axially extending bore 27 shown in phantom lines in the drawings. A plurality of inlet orifices 28 and outlet orifices 29 are bored radially inwardly through the walls of the spool providing a flow path for fluid from inlet passageway 18 to discharge passageway 22.

Biasing means comprising a coil spring 30 urges the valve member 26 to the first position shown in FIG. 1. A threaded element 31 is provided for adjustably varying the biasing force or preload of the spring 30. Threaded element 31 is locked in adjusted position by a lock nut 31*a*. A cap 32 prevents external leakage.

Valve member 26 is further provided with a plurality of lands machined in its outer surface and identified with the reference characters 33, 34, 35 and 36. The lands serve to confine the fluid within chambers formed by the central bore in the valve body and side walls of the lands, and channel it through the various passageways provided as is known in the art.

As indicated above, flow from pump P1 is into passageway 18 and from passageway 18 into the chamber formed between the lands 33 and 34. Flow from this chamber is directed through orifices 28, through the axial bore 27 in valve member 26, out through openings 29 and through discharge passageway 22 and line 24 to the load. Flow from pump P2, when the parts are as shown in FIG. 1, is into passage 19, through holes 37 drilled in land 36, into the cavity downstream from the land where it combines withflow from pump P1 and is discharged through outlet passageway 22. In order to prevent fluid flow from discharge back to suction, a check valve 38 is mounted for axial movement on the valve member 26 from a position in which it closes the openings 37 to a position in which it rests against the stop ring 39.

Figure 2:
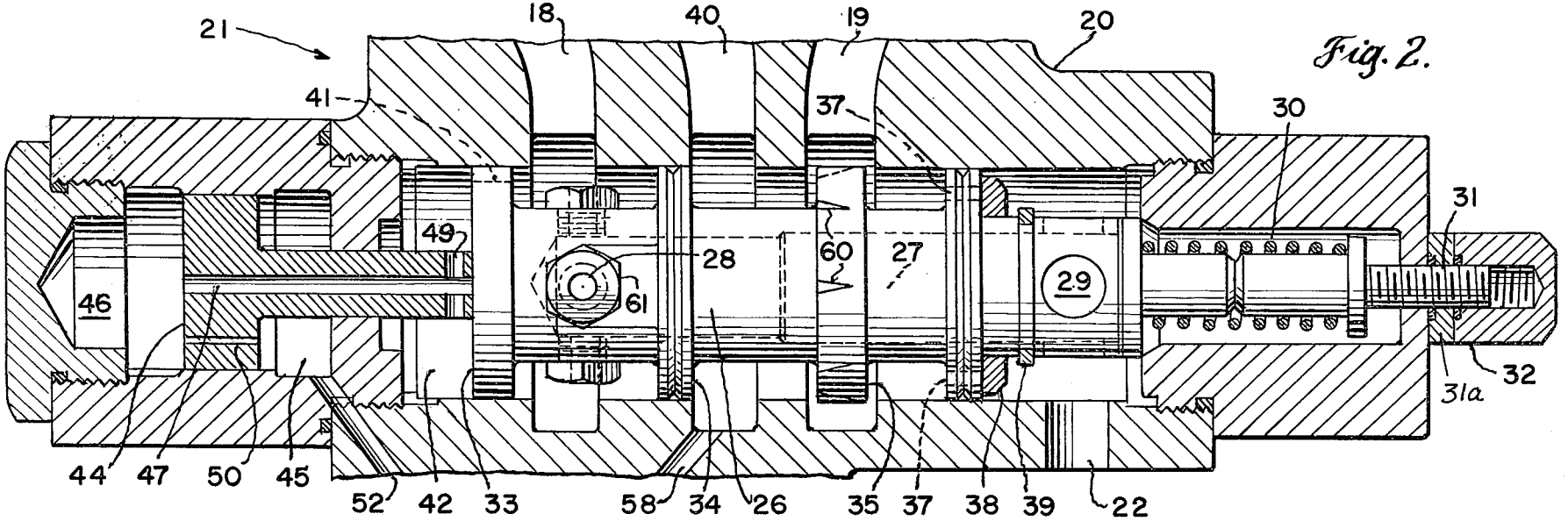
FIG. 2 is a sectional view of a portion of the control valve of FIG. 1 showing one condition of operation of certain of the valve parts.
Figure 3:
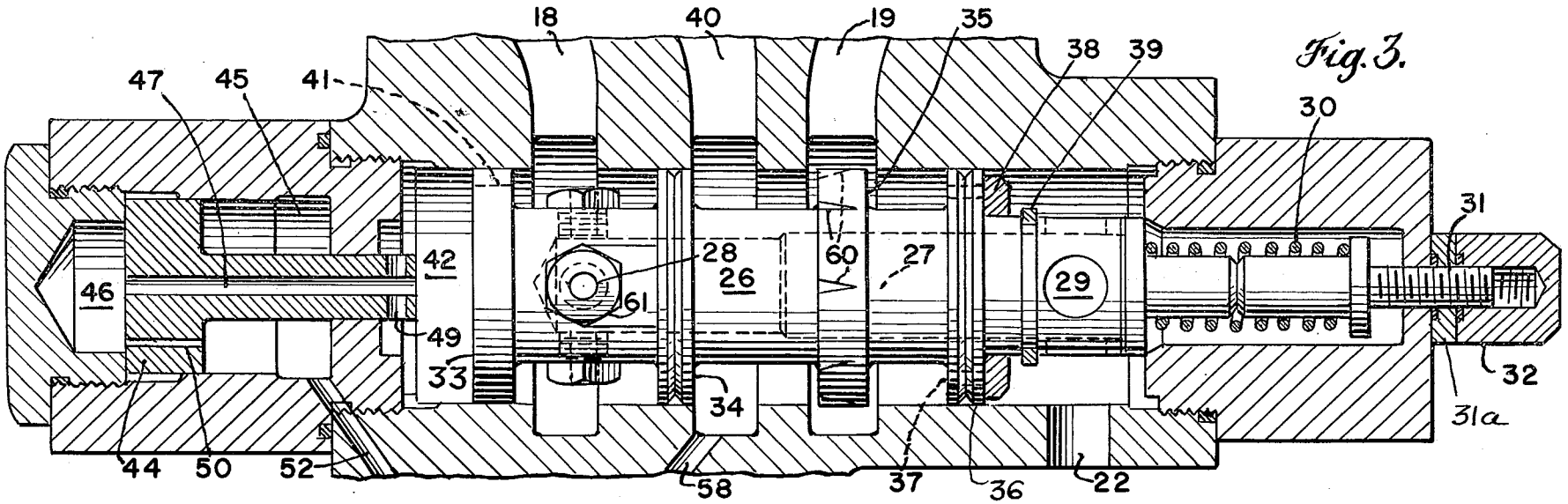
FIG. 3 is a sectional view of a portion of the control valve of FIG. 1 showing another condition of operation of certain of the valve parts.

Valve member 26 is moved against the bias of spring 30 to the position shown in FIGS. 2 and 3 by means responsive to the sensing of a predetermined excess flow or load pressure as described hereinafter. When the valve member is in the position shown in FIGS. 2 and 3, pump P2 is unloaded, that is the output of the pump is diverted from passageway 19 to a second valve outlet or bypass passage 40 back to the suction side of the pumps.

In the embodiment of the invention illustrated, the means for shifting valve member 26 to unload pump P2 is comprised of separate mechanisms, one of which is responsive to predetermined excess pressure and one of which is responsive to predetermined excess flow. Unloading the pump in response to excess pressure is accomplished by means including a flow passageway 41 located in the land 33 on the left most end of valve member 26 as viewed in the drawings. A cavity 42 is adjacent the land 33. A piston 44 is slidably mounted within a chamber 45, and bears against the end of valve member 26 when the parts are as shown in FIG. 1. A cavity 46 is adjacent the face or head of the piston 44. Piston 44 is provided with an axial bore 47 and radially extending passages 49 so that communication is established with cavity 42. By means of the above described passages a part of the flow from pump P1 is directed through passageway 41, cavity 42, orifice 49 and bore 47 into the cavity 46.

A bleeder orifice 50 through the head of piston 44 leads to the cavity 45 which in turn is in communication with a valve chamber 51 via a passageway 52.

A pressure responsive valve means comprising an orifice 53 and a poppet valve 54 blocks flow from chamber 51. Poppet valve 54 is biased to a position in which the orifice is closed by suitable biasing means such as spring 55. A set screw 56 provides for preloading the spring 55 and hence the bias on poppet 54. As shown in the drawing set screw 56 is provided with a lock nut for holding it in adjusted position and cap for preventing leakage of operating fluid.

Downstream from the poppet 54, is a chamber 57 and a passageway 58 leading to pump suction via second valve discharge passage 40.

If the discharge or load pressure increases above a particular preselected upper limiting pressure value, the output of pump P2 is diverted back to suction in the following manner. When pump P1 begins discharging fluid through passageway 18, there is a flow through the opening 41 in land 33 through passageway 49 and 47 in piston 44 and into cavity 46. The orifice 50 in the piston 44 permits flow from cavity 46 into chamber 45, through passageway 52 to chamber 51. During operation, when the pressure reaches a predetermined limiting value as determined by the setting of the adjusting screw 56, poppet valve 54 lifts off its seat and flow takes place through the passages just described back to pump suction via chamber 57, passageway 58, and second valve outlet passage 40. This results in a pressure drop across the orifice 50 with the pressure being lower in chamber 45 than in chamber 46 and piston 44 forces spool 26 to the right against the preload of spring 30. Shifting of the spool to the right to the position shown in FIG. 2 causes the flow of fluid from pump P2 to be diverted to second valve outlet passageway 40 from whence it circulates back to suction.

In order to gradually divert the flow of fluid from inlet passageway 19 to outlet passageway 20 v-shaped metering notches or grooves 60 are provided in the land 35. These grooves provide for a gradually increasing rate of flow during the movement of the valve to the position shown in FIG. 2. The check valve 38 closes openings 37 in the land 36 and prevents the flow of fluid from the discharge back to suction as the valve member shifts to the right.

Unloading of pump P2 in response to a particular limiting value of flow takes place in the following manner. Assume that both pumps are discharging fluid to the load and the pressure remains below the predetermined limit of shift pressure. Flow orifices 28 are calibrated so that the pressure upstream of the orifice as compared with the downstream pressure causes a shift of the valve member 26 to the righthand position as viewed in FIG. 1 when the flow reaches the level at which objectionable noise is created. At this point, spool or valve member 26 shifts independently of the piston 44. The shift point with respect to flow can be adjusted by adjusting set screw 31 to change the preload on the biasing spring 30. Greater changes can be made by installing different sized orifice in the spool member and for this purpose, the orifices are drilled in threaded members 61 which are fitted into threaded openings in the valve member 26 for ease of replacement. The location of the parts when a flow responsive shift takes place is shown in FIG. 3.

In summary, in a vehicle having driving means and auxiliary equipment adapted to be power operated such as a refuse packer, the motor for propelling the vehicle drives fixed displacement pumps at variable speed depending upon the manner in which the vehicle is operated. Although other conditions of operation will cause a pump to unload in response to excess flow, the condition of operation for which the flow responsive feature of the invention is most applicable occurs during the driving of the vehicle between pickup points with clutch engaged so that the pumps are operating to power the hydraulic refuse packer. The flow responsive mechanism is operative in response to flow rate as the vehicle engine speeds up to a predetermined speed at which hydraulic noise becomes objectionable. At this point the mechanism actuates the control valve means to effectively disable one of the pumps by diverting its flow back to pump suction.

Should the pressure increase above the predetermined critical level as for example during the last part of a power stroke, the pressure responsive mechanism operates to unload the pump. The above-described mechanisms contribute to the operation of a power operated vehicle having hydraulically actuated auxiliary equipment in a manner which dramatically reduces the high pitched hydraulic noise commonly arising from the operation of such equipment. Use of the invention facilitates the operation of the hydraulically actuated equipment during conditions of operation which were heretofore impractical because of the objectionable noise created.

We claim:

1. In a fluid control system, a pair of fixed displacement pumps each having supply and discharge passages for supplying operating fluid from a reservoir to a load, control valve means including a movable valve member and valve passages for delivering the fluid discharged from the pumps to the load, said valve member being movable to a first position to combine the flow of fluid from said pumps for delivery to the load and to a second position in which the flow of fluid from a first one of said pumps is delivered to the load and in which flow from the other one of the pumps is by-passed from delivery to the load and valve actuating means operative in response to a predetermined upper limit of flow and to a predetermined upper limit of pressure downstream from one of the said pumps for moving the valve member to the second position when either the predetermined upper limit of flow or the predetermined upper limit of pressure is reached.

2. A fluid control system according to claim 1 wherein said valve actuating means comprises a pressure responsive device in communication with a first one of said valve passages, said valve actuating means being operative to shift the valve member from the first position to the second position in response to a predetermined upper limit of pressure and further comprises a flow responsive device, said flow responsive device being responsive to flow in one of said valve passages and being operative to shift the valve member from the first position to the second position in response to an upper limit of flow in another one of said valve passages.

3. A fluid control system according to claim 2 wherein said flow responsive device comprises a flow restrictive orifice in the first one of said passages and means for shifting said valve member from the first position to the second position in response to a predetermined pressure imbalance across said orifice.

4. A fluid control system according to claim 3 wherein said flow restrictive orifice is located in said valve member and comprises the flow passage from said one pump through the valve means.

5. A fluid control system according to claim 2 wherein said pressure responsive device comprises a second valve member in fluid communication with the output of one of said pumps and a shiftable piston engageable with the first named valve member and operable in response to a pressure differential on opposite sides thereof to shift said first named valve member to the second position, said second valve being operable in response to said upper limiting pressure for establishing said pressure differential across said piston.

6. A vehicle having driving means and auxiliary equipment adapted to be power operated, a variable speed motor for selectively operating the driving means at different speeds, and hydraulic actuating means for the auxiliary equipment comprising two hydraulic pumps connected to be driven by the motor at different speeds according to the speed of operation of the motor and having a common hydraulic operating connection with the auxiliary equipment, control valve means for unloading one of said pumps from the common hydraulic operating connection with the auxiliary equipment, and means operatively coupled to the control valve means for actuating the control valve means to unload said one pump, said actuating means being responsive to increase in the hydraulic fluid pressure above a predetermined value in said common hydraulic operating connection and to increase in flow rate of the hydraulic fluid above a predetermined value in said common hydraulic operating connection to actuate the control valve means to unload said one pump.

7. Equipment according to claim 6 wherein said means for actuating the control means comprises a separate flow responsive mechanism responsive to increase in flow rate of the hydraulic fluid above a predetermined value in said common hydraulic connection to actuate the control valve means to unload said one pump and further comprises a separate pressure responsive mechanism responsive to increase in the hydraulic fluid pressure above a predetermined value in said common hydraulic connection to actuate the control valve means to unload said one pump.

8. Equipment according to claim 6 wherein said control valve means comprises a movable valve member, valve passages for delivery of fluid from the pumps to the auxiliary equipment, said valve member being movable to a first position to permit the flow of fluid from said pumps to the auxiliary equipment and to a second position in which the flow from said one of said pumps is diverted and said valve means further comprising a spring for biasing the valve member to the first position, and wherein said actuating means moves the valve member to the second position in response to increase in flow or pressure above said predetermined values.

9. In a fluid control system, a reservoir; a pair of engine driven fixed displacement pumps, each having supply and discharge passages for the supply and discharge of operating fluid from the reservoir; a control valve comprising a valve housing, said valve housing including first and second inlet passages each connected to the discharge passage of an individual one of said pumps, first and second valve outlet passages, said second valve outlet passage communicating with the reservoir, said control valve further including a spool member mounted for movement within said housing between first and second positions, said spool member being operative in the second position to provide for a communication of said second valve inlet passage with said second valve outlet passage, said spool member being operative in the first position to connect said first and second valve inlet passages to said first valve outlet passage, and means for moving the spool member to the second position whenever a predetermined pressure or flow is exceeded.

10. In equipment having a principal mechanism for performing a primary function and auxiliary mechanism for performing a collateral function, a variable speed motor for selectively operating the principal mechanism at different speeds, and hydraulic actuating means for the auxiliary mechanism comprising a plurality of hydraulic pumps connected to be driven by the motor at different speeds according to the speed of operation of the motor and having a common hydraulic operating connection with the auxiliary mechanism, control means for diverting the fluid output of at least one of said pumps from the common hydraulic operating connection with the auxiliary mechanism, and two control devices for actuating the control means to divert the fluid output of the pump whose output is to be diverted from the common hydraulic operating connection with the auxiliary mechanism, one of said devices being responsive to increase in the hydraulic fluid pressure above a predetermined value in said common hydraulic operating connection to divert the fluid output of said pump from the common hydraulic operating connection with the auxiliary mechanism and the other of said devices being responsive to increase in flow rate of the hydraulic fluid above a predetermined value in said common hydraulic operating connection to divert the fluid output of said pump from the common hydraulic operating connection with the auxiliary mechanism.

11. In combination in a vehicle, an engine operative at variable speeds to provide a propulsion of the vehicle in accordance with the speed of the engine and capable of operating at low speeds approaching idling, an auxiliary mechanism having properties of operating on a cyclic basis and of providing an individual load at different times in the operation cycle and of providing functions independent of the operation of the vehicle, reservoir means for the hydraulic fluid, pump means operated by the engine for providing for a flow of fluid from the reservoir means to the auxiliary mechanism in accordance with the speed of the engine, the pump means having a first state of operation for providing for the introduction of the hydraulic fluid from the reservoir means to the auxiliary mechanism and having a second state of operation for providing for a by-pass of at least a portion of the fluid from the reservoir means to prevent such fluid from being effective in operating the auxiliary mechanism, and valve means responsive to the pressure of the fluid from the pump means and to the volume of fluid flow from the pump means for providing for the operation of the pump means in the second state at a fluid pressure above a particular value or a fluid flow above a particular value and for providing for an operation of the pump means in the first state at other times corresponding to speeds approaching the idling speed of the engine.

12. In the combination set forth in claim 11 wherein the valve means includes first means responsive to increases in the pressure of the fluid from the pump means above a first particular value for limiting the amount of fluid flowing to the auxiliary mechanism and further includes second means responsive to increases in the volume of fluid from the pump means above a second particular value for limiting the amount of fluid flowing to the auxiliary mechanism.

13. In the combination set forth in claim 12, the auxiliary mechanism being constructed to provide a packing of refuse in the vehicle.

14. The combination set forth in claim 13 wherein the valve means includes a valve member movable between a first position providing for a full delivery of fluid from the reservoir means to the auxiliary mechanism and a second position providing for a partial delivery of fluid from the reservoir means to the auxiliary mechanism and wherein the valve member is normally in the first position and the first means is responsive to increases in the pressure of the fluid from the pump means above the first particular value for obtaining a movement of the valve member to the second position and wherein the second means is responsive to increases in the flow of the fluid from the pump means above the second particular value for obtaining a movement of the valve member to the second position.

15. The combination set forth in claim 14 wherein the pump means includes first and second pumps and the valve member is operative in the second position to bypass the second pump for supplying fluid from the reservoir means to the auxiliary mechanism.

16. In combination in a vehicle, an engine operative at variable speeds to provide a propulsion of the vehicle in accordance with the speed of the engine and capable of operating at low speeds approaching idling, an auxiliary mechanism providing properties independent of the movement of the vehicle and operative on a cyclic basis and providing a variable load at different times in each cycle, pump means operatively coupled to the engine and having properties of providing fluid to the auxiliary mechanism in accordance with speed of the engine and having first and second states of operation and operative in the first state to provide a full flow of the fluid to the auxiliary mechanism to operate the auxiliary mechanism and operative in the second state to by-pass at least a portion of the fluid from flowing to the auxiliary mechanism to operate the auxiliary mechanism; and valve means operatively coupled to the pump means and the auxiliary mechanism for providing the operation of the pump means in the first state to obtain a full flow of the fluid from the pump means to the auxiliary mechanism for pressures of the fluid below a particular pressure value and for volumes of fluid flow below a particular flow value corresponding to speeds of the engine approaching idling and for providing an operation of the pump means in the second state for pressures of the fluid at least equal to the particular pressure value or for volumes of fluid at least equal to the particular flow value to obtain a by-pass of at least a portion of the fluid back to the pump means.

17. The combination set forth in claim 16 wherein the pump means includes first and second pumps and the valve means operates to bypass the fluid to a particular one of the first and second pumps for fluid pressures at least equal to the particular pressure value or volumes of fluid flow at least equal to the particular flow value to prevent the fluid from flowing to the auxiliary mechanism.

18. The combination set forth in claim 16 wherein the valve means includes a valve member normally operative in a first position and movable to a second position in response to fluid pressures at least equal to the first particular value or volumes of fluid flow at least equal to the second particular value and wherein the valve means are constructed to bypass at least a portion of the fluid to the pump means in the second position of the valve member.

19. The combination set forth in claim 18 wherein the auxiliary mechanism constitutes a packing mechanism for refuse and the pump means includes first and second pumps and the valve means is operative to bypass the fluid to a particular one of the first and second pumps in the second position of the valve member.

20. The combination set forth in claim 19, including, a reservoir for storing hydraulic fluid, the pump means being operative to deliver hydraulic fluid from the reservoir to the auxiliary mechanism to operate the auxiliary mechanism.

* * * * *